US007510436B2

(12) United States Patent
Peng

(10) Patent No.: US 7,510,436 B2
(45) Date of Patent: Mar. 31, 2009

(54) MULTI-CONNECTOR SET FOR SIGNAL TESTING

(75) Inventor: Chang Lin Peng, Jhonghe (TW)

(73) Assignee: FTIME Technology Industrial Co., Ltd., Taipei County (TW)

( * ) Notice: Subject to any disclaimer, the term of this patent is extended or adjusted under 35 U.S.C. 154(b) by 52 days.

(21) Appl. No.: 11/756,791

(22) Filed: Jun. 1, 2007

(65) Prior Publication Data

US 2008/0299823 A1 Dec. 4, 2008

(51) Int. Cl.
*H01R 9/05* (2006.01)

(52) U.S. Cl. ..... 439/581; 324/754

(58) Field of Classification Search ..... 324/754, 324/755; 439/578, 871, 912, 778, 721, 723
See application file for complete search history.

(56) References Cited

U.S. PATENT DOCUMENTS 6,344,736 B1 * 2/2002 Kerrigan et al. ..... 324/158.1
6,809,524 B1 * 10/2004 Sadler et al. ..... 324/538
7,053,643 B2 * 5/2006 Ruff et al. ..... 324/761
2007/0004246 A1 * 1/2007 Holmberg et al. ..... 439/73

* cited by examiner

*Primary Examiner*—Renee S Luebke
*Assistant Examiner*—Larisa Tsukerman
(74) *Attorney, Agent, or Firm*—Ming Chow; Sinorica, LLC

(57) ABSTRACT

A multi-connector set for signal testing having a rectangular base seat installed with a fixed testing connector and two adjustable testing connectors provided at the two lateral sides of the fixed testing connector for adjusting spaces of them from the fixed testing connector. The fixed and the adjustable testing connectors each has an SMA female connector, the base seat has on its bottom a cylindrical shank that has a bottom protecting cylinder to be moved up and down by protruding and retracting or be rotated or tilted, and each fixed and each adjustable testing connector has at its bottom a probe which further has a secondary female probe moving up and down by protruding and retracting; the secondary female probe has a bottom recess to be slipped over a probe at the center of an I-PEX connector. Thereby, multiple microwave electric circuits can be tested at one time to save time; and insertion holes on the bottoms of the fixed and the adjustable testing connector can be correctly slipped over the central probe of the I-PEX connector every time, this can increase the correctness of tested results.

10 Claims, 12 Drawing Sheets

MULTI-CONNECTOR SET FOR SIGNAL TESTING

BACKGROUND OF THE INVENTION

1. Field of the Invention

The present invention relates to a multi-connector set for signal testing, and especially to a multi-connector set having multiple testing connectors assembled on a base seat to be adjustable in spacing for the purpose of testing multiple microwave electric circuits.

2. Description of the Prior Art

By virtue that the wireless communication technique has been advancing rapidly, high-frequency signal transmitting has been being applied to products such as mobile phones, PDAs, notebooks, wireless keyboards or mice etc. These wireless communication products use high-frequency electronic elements and antennas and attach them to an electric circuit board to thereby form a microwave electric circuit with a specific function. Alternatively, multiple sets of microwave electric circuits can be provided on one electric circuit board.

Referring to FIG. 2, one of such electric circuit board 91 may be provided thereon with a plurality of Radio Frequency (RF) end-connectors 92, and a testing connector 93 is used to contact sequentially with every probe 921 in the RF connectors 92, thus transmitted signals in each microwave electric circuit can be taken, and can be transmitted to a network analyzer 95 through a coaxial electric cable 94 to measure and analyze various high-frequency electric characters.

FIG. 1 shows a conventional testing connector 93 which has thereabove an SMA (Sub-Miniature Type A) female connector 931 adapted to connecting with an SMA male connector 941 on the tailing end of the coaxial electric cable 94, by connecting of a probe 932 provided at the center of an inner insulating seat 933, signal can thus be taken.

However, such a single conventional testing connector 93 must be connected one by one with the RF connectors 92 for testing, this will waste much time; particularly because the central probe 932 in the testing connector 93 has a recess 934 on its bottom end which is enveloped with a fixed protecting cylinder 935, when it is connected with a connector 92 on the electric circuit board 91, it is subjected to having deviation of insertion angle; and this tends to make error of the high-frequency signal taken, and to make error of the result of the network analyzer 95, or even to affect allocation of the electric circuit board.

SUMMARY OF THE INVENTION

In view of the defects of the conventional technique, the present invention is provided with a multi-connector set for signal testing comprising a rectangular base seat, the base seat is installed thereon with a fixed testing connector, and two adjustable testing connectors are provided respectively at the two lateral sides of the fixed testing connector for the purpose of adjusting spaces of them from the fixed testing connector; the fixed testing connector and the adjustable testing connectors each has an SMA female connector, the base seat is designed to have on its bottom a cylindrical shank, and the bottom of the cylindrical shank is provided with a protecting cylinder that can be moved up and down by protruding and retracting, or be rotated or tilted, and each fixed and each adjustable testing connector has at its bottom a probe which further has a secondary female probe that moves up and down by protruding and retracting, further, the bottom of the secondary female probe is provided with a recess that can be slipped over a probe provided at the center of an RF connector. Thereby, multiple microwave electric circuits can be tested at one time; and insertion holes on the bottoms of the fixed testing connector and the adjustable testing connector can be correctly slipped over the central probe of the RF connector every time, and this can make increasing and make new records of correctness of the tested results of the multi-connector set for signal testing.

The multi-connector set for signal testing provided by the present invention needs not to adjust the spaces of the adjustable testing connectors from the fixed testing connector to get the object of fast testing when the positions of the RF connectors have small deviations, such as when the positions of the connectors welded to an electric circuit board are higher or lower, this is because the protecting cylinder and the secondary female probe are able to be micro-adjusted.

The present invention will be apparent in its structural feature and effect of operation after reading the detailed description of the preferred embodiment thereof in reference to the accompanying drawings.

DETAILED DESCRIPTION OF THE PREFERRED EMBODIMENT

The multi-connector set for signal testing of the present invention is connected with a plurality of RF connectors on an electric circuit board to take high-frequency signal for an analyzer to measure and analyze.

Figure 1:
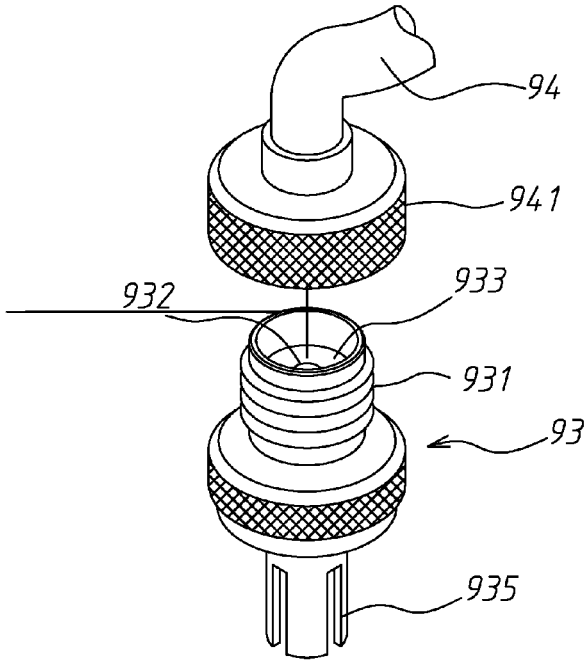
FIG. 1 PRIOR ART
FIG. 1 is an anatomic perspective view of a conventional signal testing connector and a coaxial cable.
Figure 2:
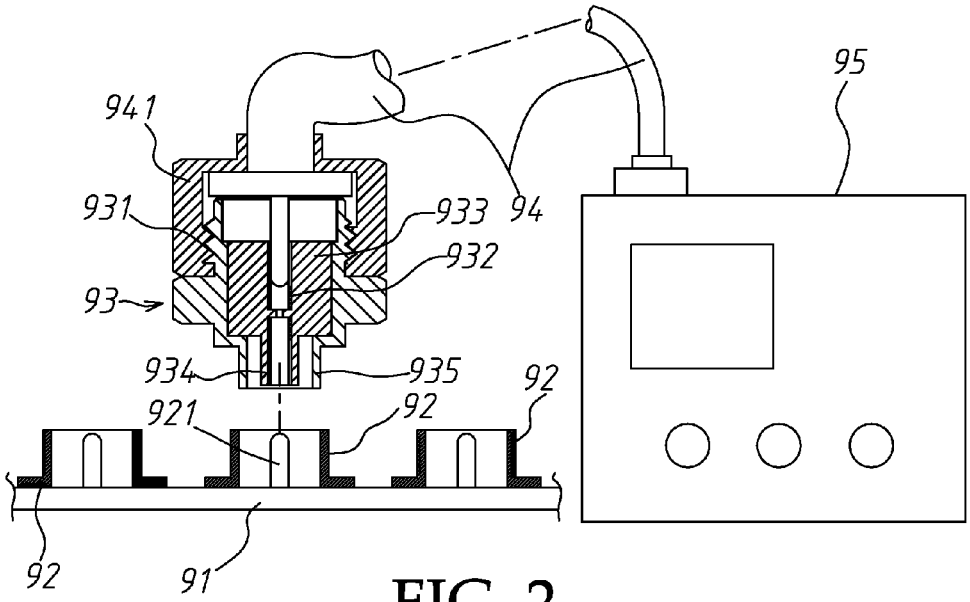
FIG. 2 PRIOR ART
FIG. 2 is a schematic view showing the conventional signal testing connector in combination with an electric circuit board, the coaxial cable and a network analyzer.
Figure 3:
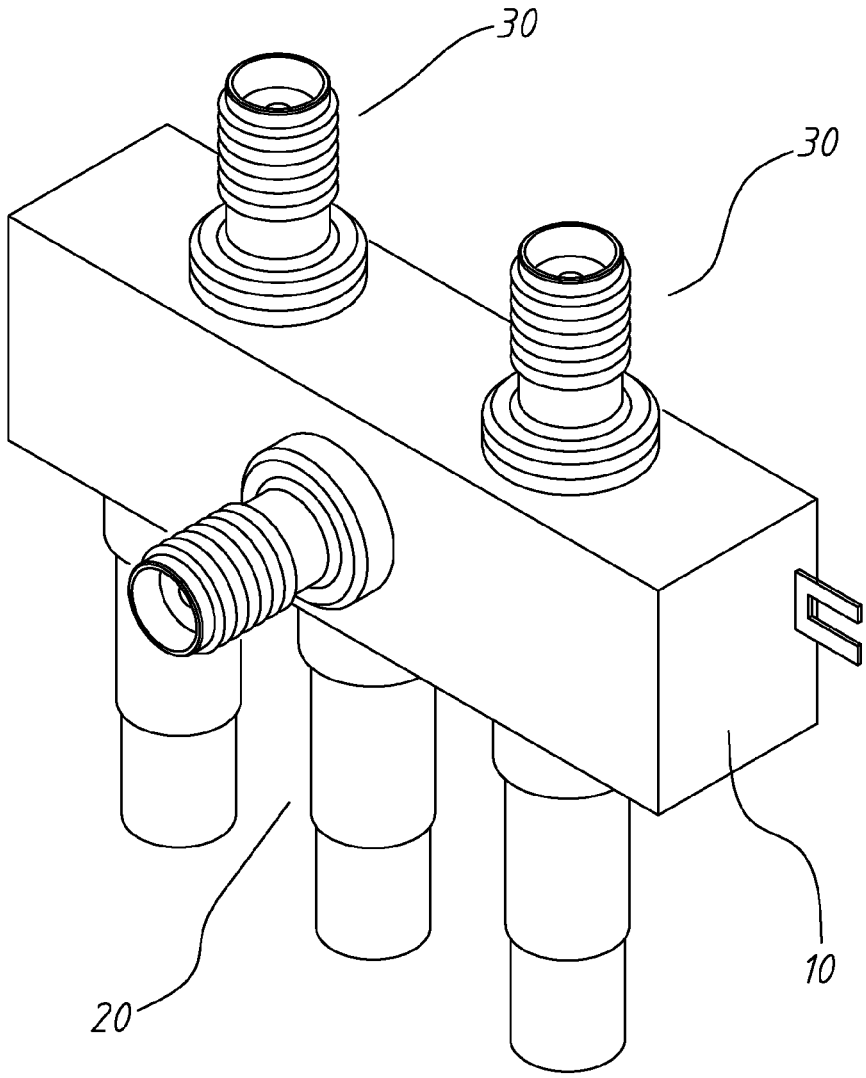
FIG. 3 is a perspective view showing the appearance of the present invention.
Figure 4:
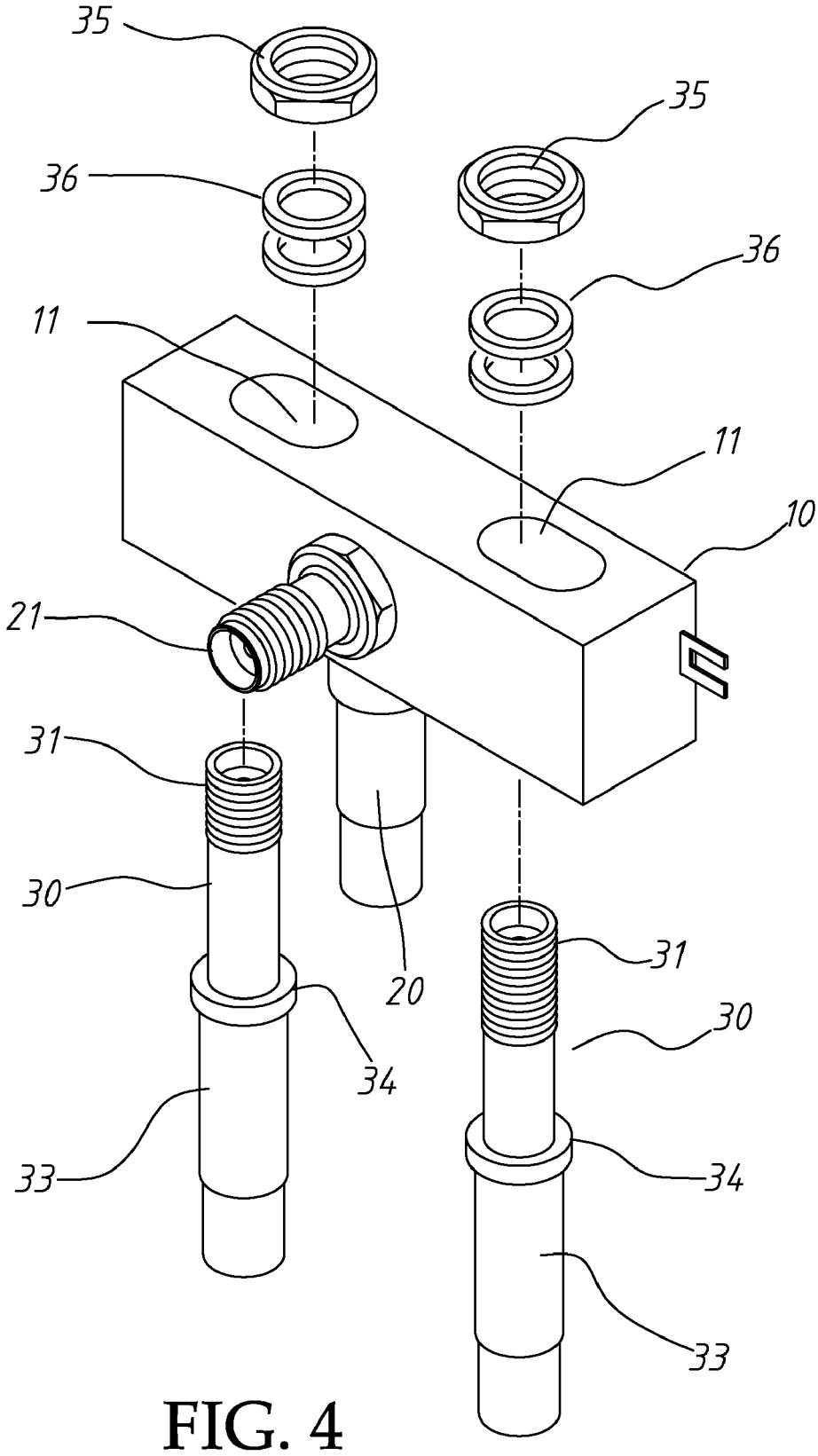
FIG. 4 is an anatomic perspective view of the most parts of the present invention.

Referring to FIGS. 3 and 4, the present invention has a base seat 10, a fixed testing connector 20 and two adjustable testing connectors 30.

The base seat 10 is a rectangular member being opened thereon with two elongate holes 11 extending down through the base seat 10 from above for receiving an adjustable testing connector 30 each; and the positions of the adjustable testing connectors 30 can be adjusted in the elongate holes 11 to adjust their positions and spaces from the fixed testing connector 20 which is positioned at a middle position.

The fixed testing connector 20 is provided at the center of the base seat 10, and has an SMA female connector 21 connecting with an SMA male connector on the tailing end of a coaxial electric cable, and the end of a probe 22 (referring to FIGS. 10 and 13) of the SMA female connector 21 is connected with a probe provided at the center of an RF connector.

Two or more adjustable testing connectors 30 can be provided on the base seat 10, and their spaces from the fixed testing connector 20 can be adjusted. The adjustable testing connectors 30 each has an SMA female connector 31 connecting with an SMA male connector on the tailing end of a coaxial electric cable, and the end of a probe 32 of the SMA female connector 31 is connected with a probe provided at the center of an RF connector.

Figure 5:
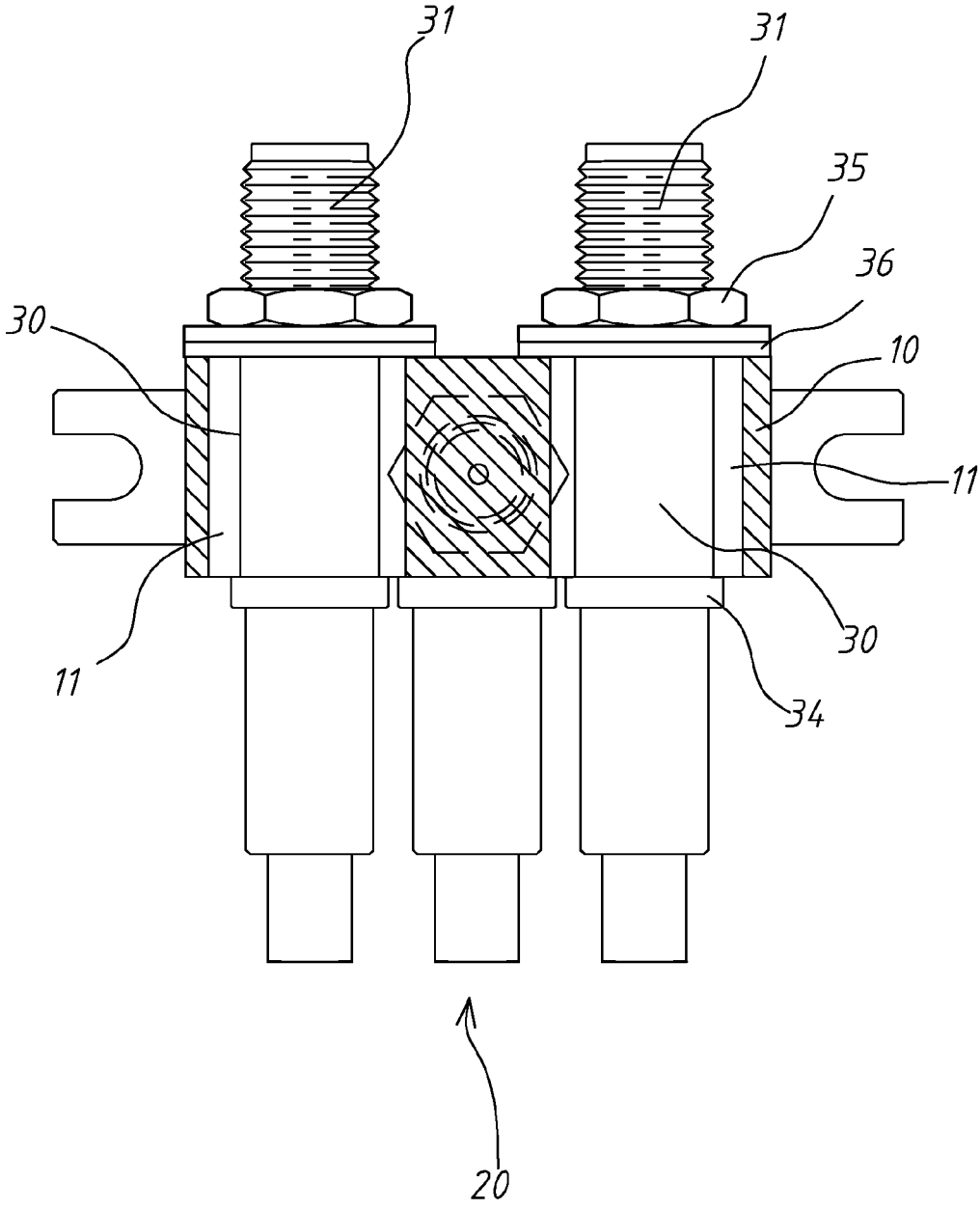
FIG. 5 is a sectional view of the present invention after assembling.
Figure 6:
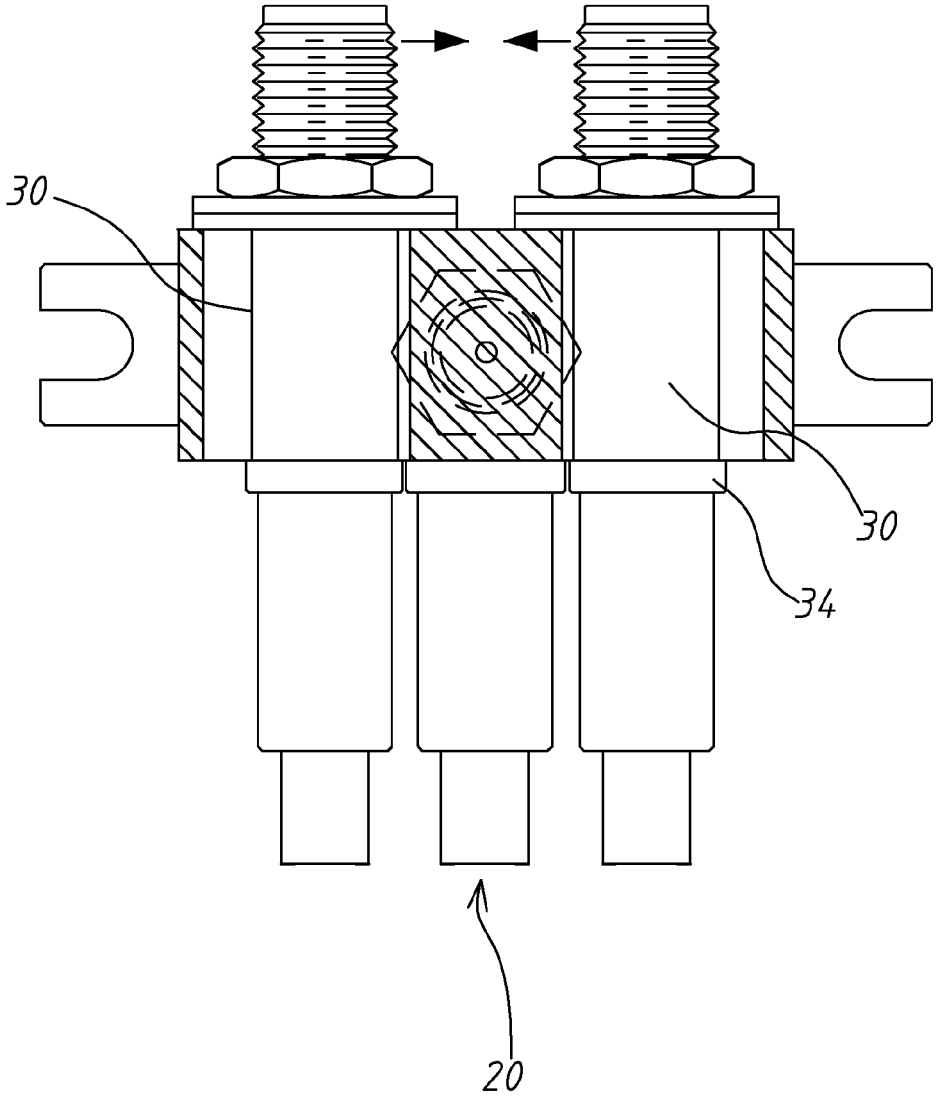
FIG. 6 is a sectional view of the present invention after assembling same as FIG. 5, but the spaces of the adjustable testing connectors from the fixed testing connector have been adjusted.

The adjustable testing connectors 30 each has a cylindrical shank 33 of which an upper end is formed one of the SMA female connectors 31, and of which a flange 34 is formed at the middle thereof, the diameter of the flange 34 is larger than the width of either of the elongate holes 11. Each cylindrical shank 33 is extended from the bottom of the base seat 10 through an elongate hole 11 to make its corresponding SMA female connector 31 protrude out of the top of the base seat 10. And a screw 35 and a set of gaskets 36 each with a diameter larger than the width of either elongate hole 11 are screw connected with an outer screw thread of its corresponding SMA female connector 31, thus the SMA female connector 31 and its corresponding flange 34 can be together fixedly clamped on the base seat 10, such as are shown in FIGS. 5 and 6.

Figure 7:
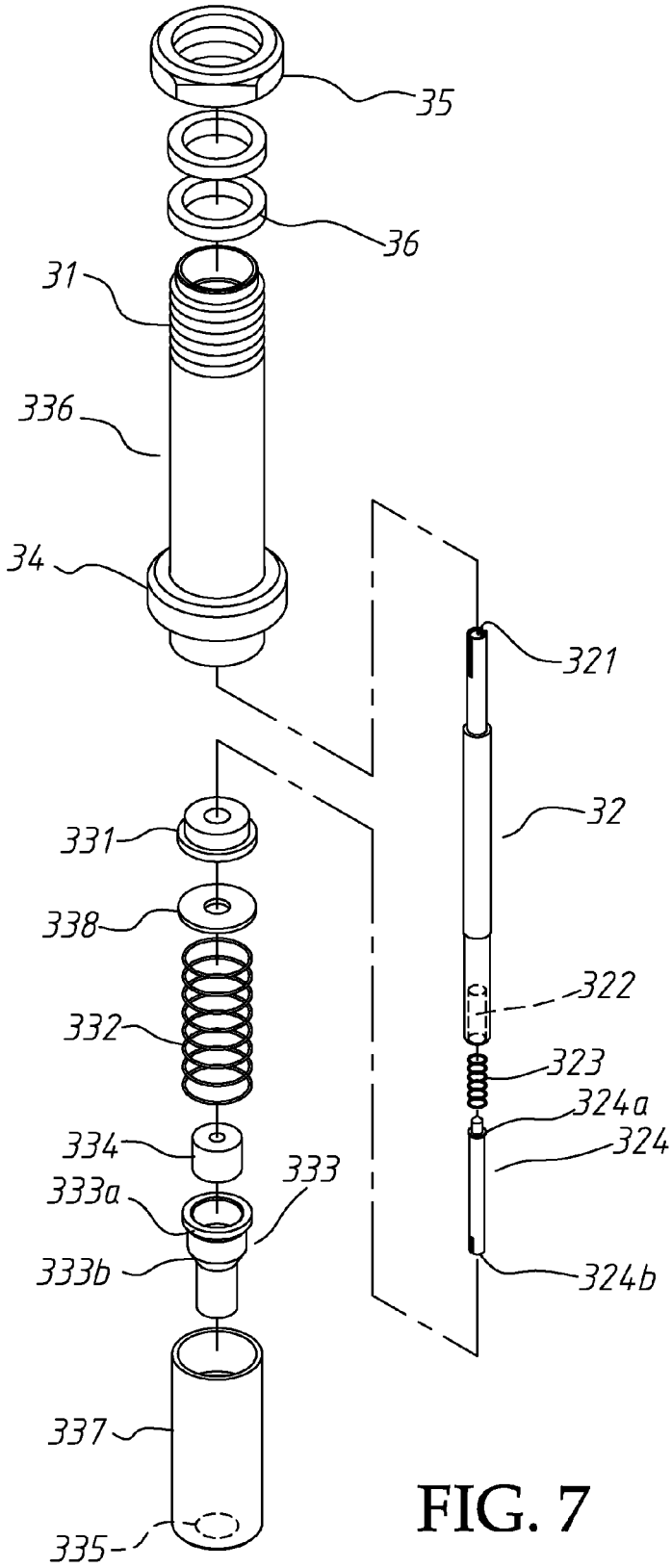
FIG. 7 is an anatomic perspective view showing the details of each of the adjustable testing connectors of the present invention.
Figure 8:
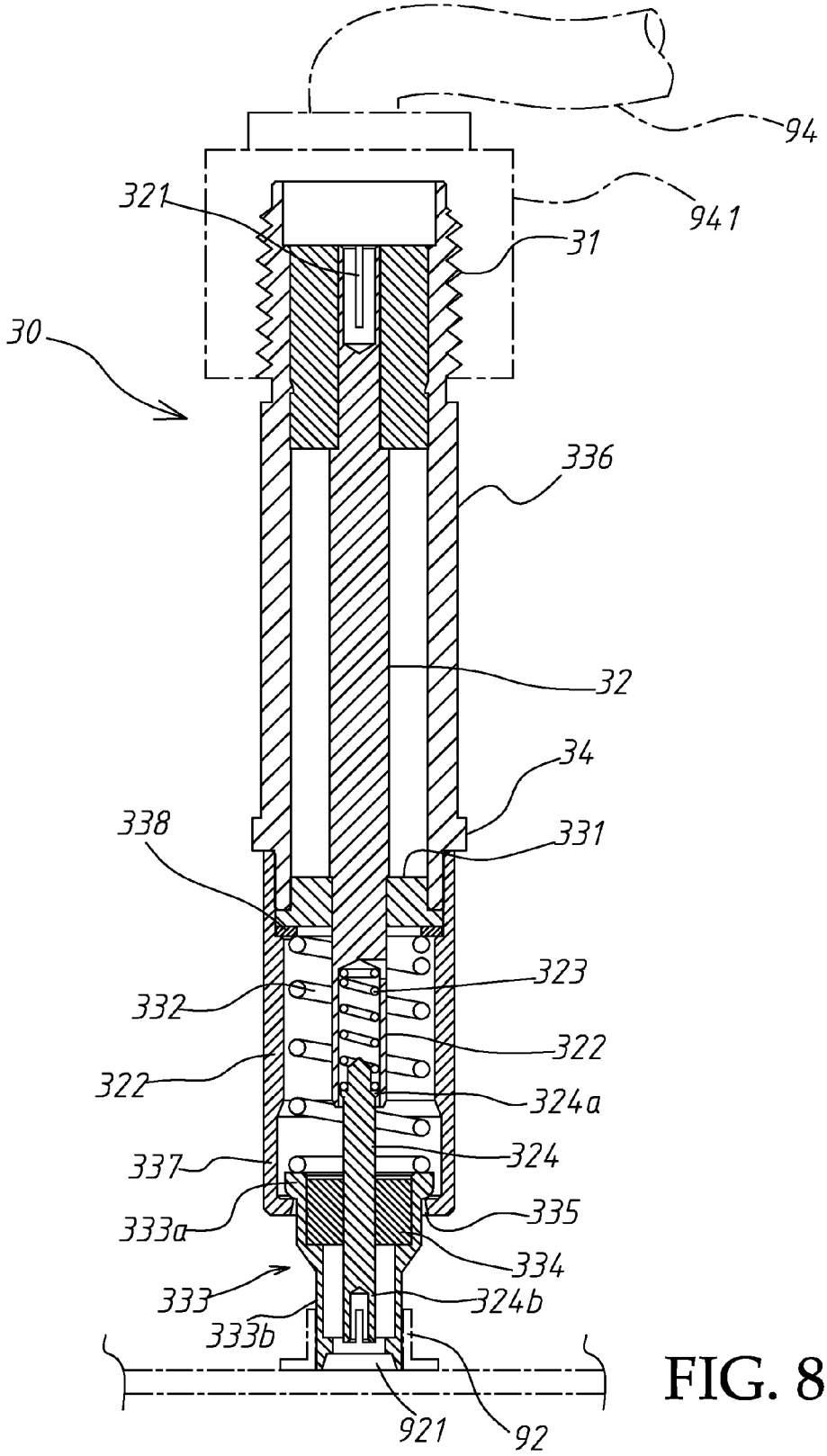
FIG. 8 is a sectional view showing an adjustable testing connector of the present invention after assembling.
Figure 10:
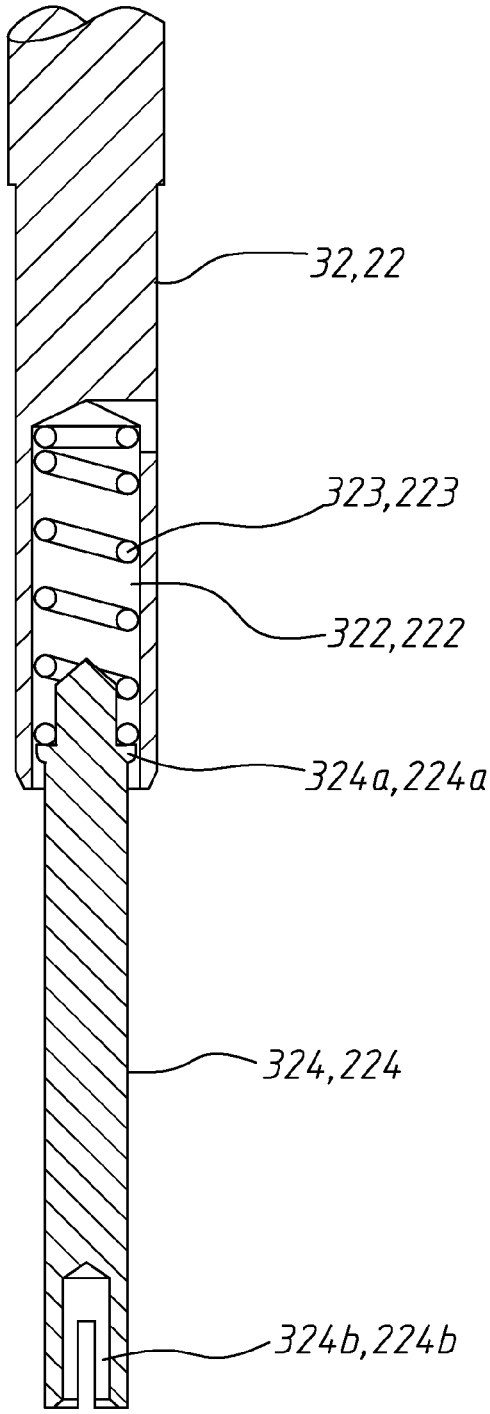
FIG. 10 is a sectional view of a probe of the present invention.
Figure 11:
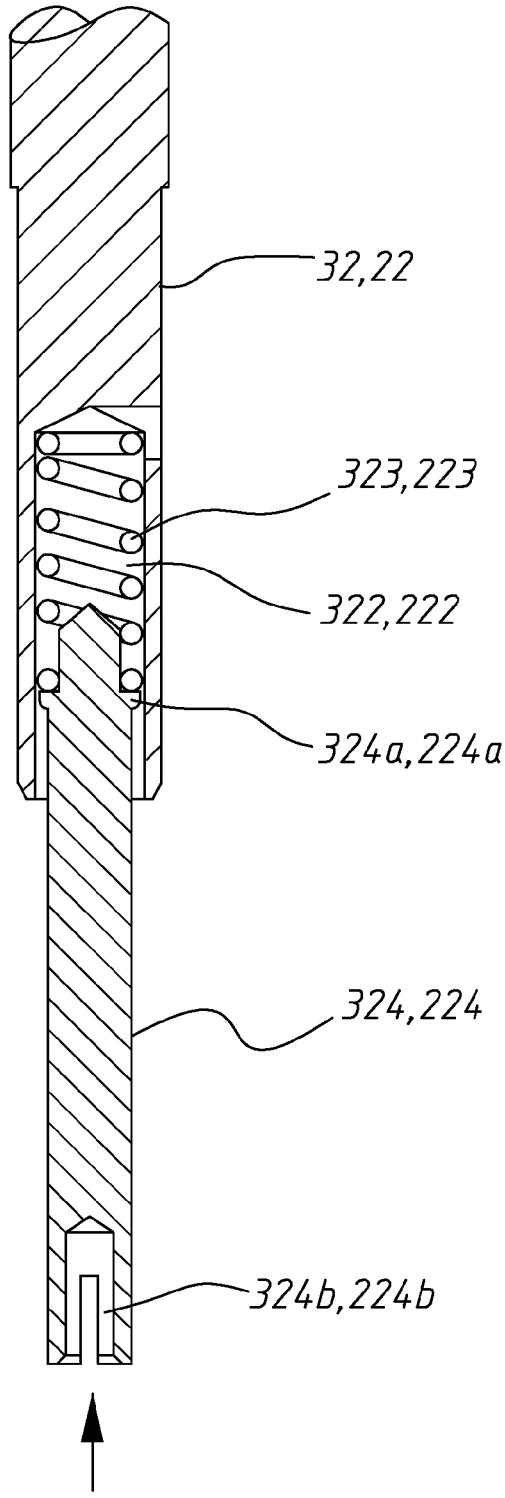
FIG. 11 is same as FIG. 10, but the position of the secondary female probe has been moved and retracted upwards.

Referring to FIGS. 7 and 8, the probe 32 of each adjustable testing connector 30 is formed on its upper end an insertion hole 321, and is formed on its lower end an inner hole 322; the inner hole 322 has therein a first spring 323 which contacts a lower enlarged portion 324*a* above a secondary female probe 324 that can be moved up and down by protruding and retracting; in comparison of FIG. 10 with FIG. 11, the secondary female probe 324 is formed on its bottom a recess 324*b* to slip over a probe provided at the center of one of the RF connectors.

Figure 9:
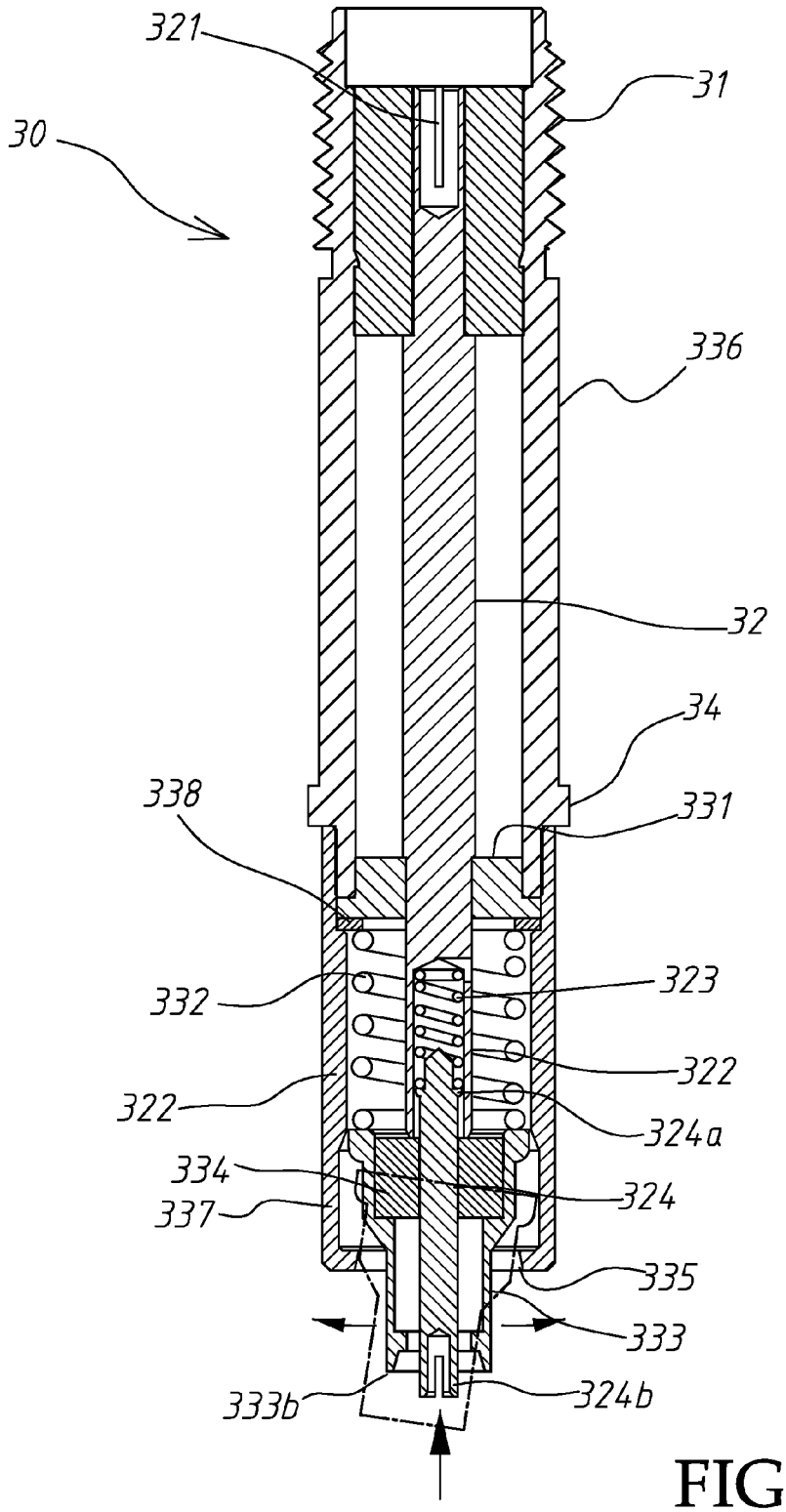
FIG. 9 is same as FIG. 7, but the position of the protecting cylinder has been moved.

In the middle section of each of the cylindrical shanks 33, there is a middle insulating seat 331 to afford extending through of the probe 32; and the middle insulating seat 331 is provided therebeneath with a second spring 332 which contacts the upper edge of a lower protecting cylinder 333; the protecting cylinder 333 is provided in its upper interior with a lower insulating seat 334 to afford extending through of its corresponding secondary female probe 324. The upper outer edge of the protecting cylinder 333 is formed a flange 333*a*, the diameter of the flange 333*a* is larger than the diameter of a bottom opening 335 of the cylindrical shank 33; the protecting cylinder 333 envelops the recess 324*b* of the secondary female probe 324, and presses the second spring 332 to move up and down by protruding and retracting on the bottom of the cylindrical shank 33 or to rotate or tilt (such as is shown by dotted line in FIG. 9).

The cylindrical shank 33 of each adjustable testing connector 30 is composed of an upper cylinder 336 and a lower cylinder 337 slipped in the upper cylinder 336, and one of the middle insulating seats 331 is provided at this slip-connecting position. The middle insulating seats 331 and its corresponding second spring 332 have therebetween an O shaped ring 338.

Figure 12:
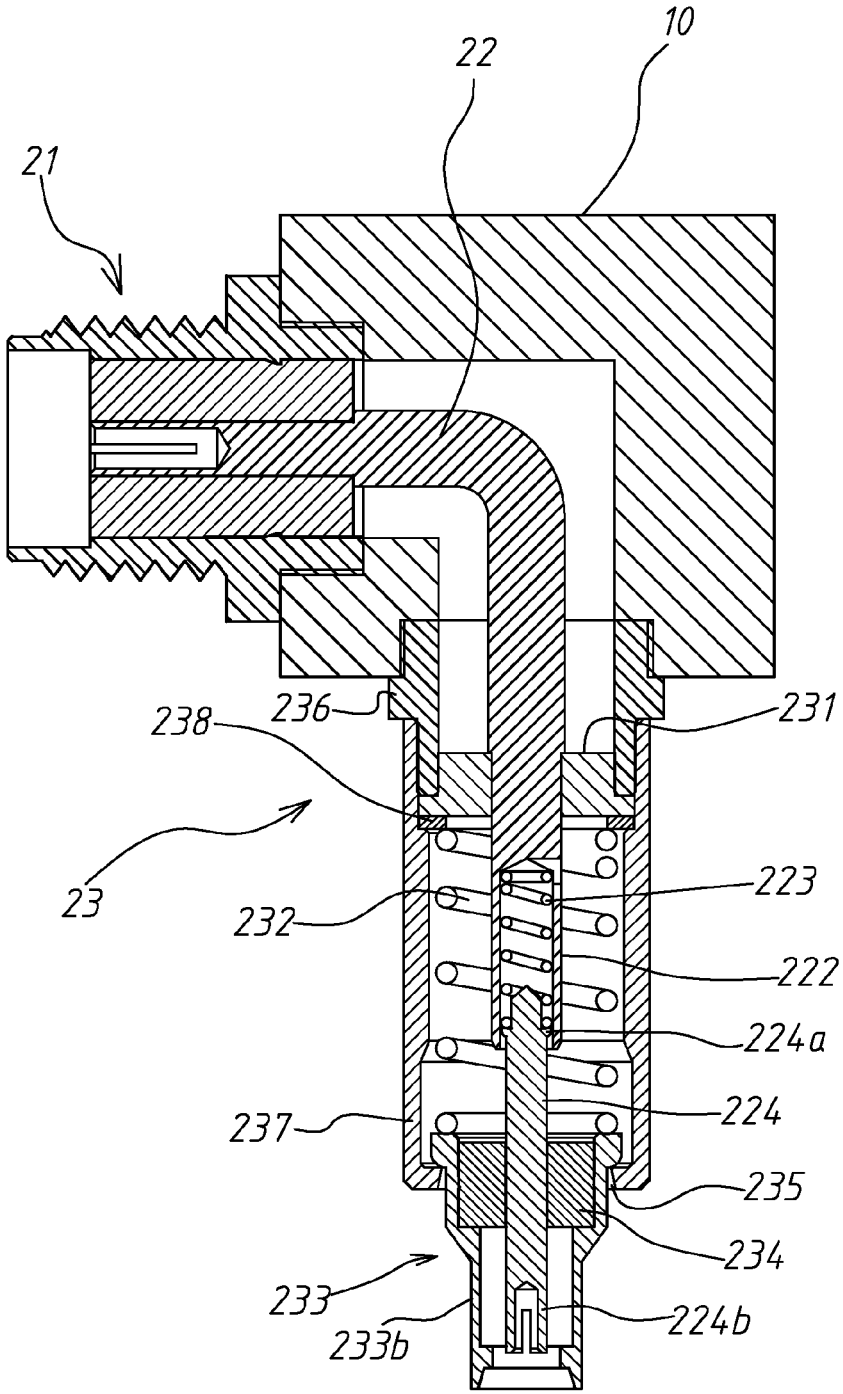
FIG. 12 is a sectional view of the fixed testing connector of the present invention.
Figure 13:
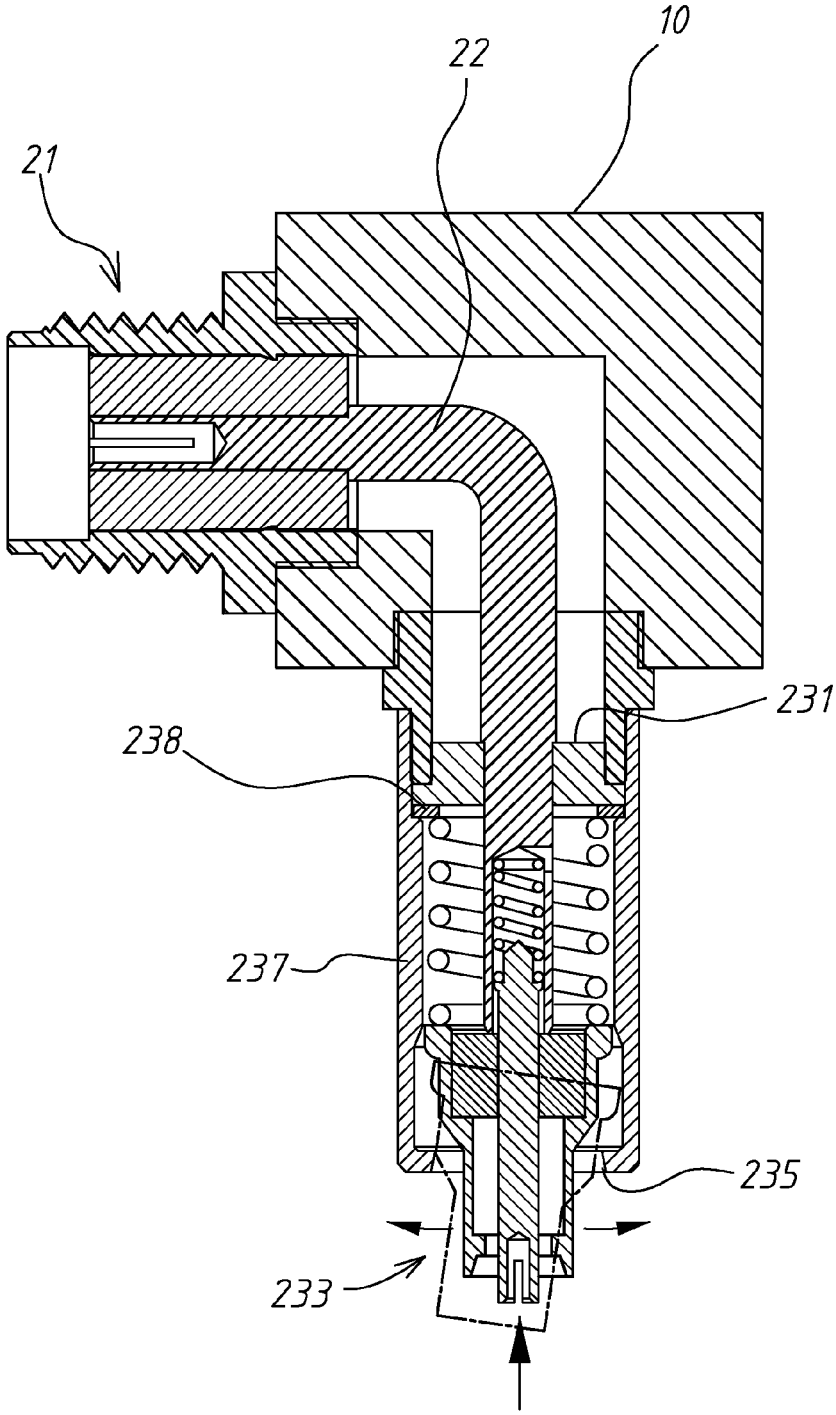
FIG. 13 is same as FIG. 12, but the position of the protecting cylinder has been moved.

Referring to FIGS. 12 and 13, the SMA female connector 21 of the fixed testing connector 20 is provided at the center in the front face of the base seat 10, and the probe 22 of the fixed testing connector 20 is bent for an angle of 90 degrees in the base seat 10. As is the structure of any of the adjustable testing connectors 30 shown in FIGS. 10 and 11, the probe 22 is formed on it lower end an inner hole 222 which is provided therein with a first spring 223 which contacts a lower enlarged portion 224*a* above a secondary female probe 224 that can be moved up and down by protruding and retracting in the inner hole 222; and the secondary female probe 224 is formed on its bottom a recess 224*b* to slip over a probe provided at the center of an RF connector on the electric circuit board.

And more, the fixed testing connector 20 also has a cylindrical shank 23 extending downwards within and from the bottom of the base seat 10; the cylindrical shank 23 has in its middle section a middle insulating seat 231 to afford extending through of the probe 22; and the middle insulating seat 231 is provided therebeneath with a second spring 232 which contacts the upper edge of a lower protecting cylinder 233; the protecting cylinder 233 is provided in its upper interior with a lower insulating seat 234 to afford extending through of the probe of the secondary female probe 224. The upper outer edge of the protecting cylinder 233 is formed a flange 233*a*, the diameter of the flange 233*a* is larger than the diameter of a bottom opening 235 of the cylindrical shank 23; the protecting cylinder 233 envelops the recess 224*b* of the secondary female probe 224, and presses the second spring 232 to move up and down by protruding and retracting on the bottom of the cylindrical shank 23 or to rotate or tilt (such as is shown by dotted line in FIG. 13).

The cylindrical shank 23 of the fixed testing connector 20 is composed of an upper cylinder 236 and a lower cylinder 237 slipped in the upper cylinder 236, the top of the upper cylinder 236 is extended into the base seat 10 to tightly fit therein, the lower cylinder 237 is slipped in the upper cylinder 236 from below, and the middle insulating seat 231 is provided at this slip-connecting position. The middle insulating seat 231 in the cylindrical shank 23 and the second spring 232 have therebetween an O shaped ring 238.

In the present invention, no matter concerning the fixed testing connector 20 or the adjustable testing connectors 30, the protecting cylinder 233 (333) always is pressed by the second spring 232 (332) to be at the lowest position in the cylindrical shank 23 (33), and thereby the flange 233*a* (333*a*) can be supported on the opening 235 (335), and a covering portion 233*b* (333*b*) is extended out of the bottom of the opening 235 (335). When the protecting cylinder 233 (333) is subjected to an upward acting force, for instance, when it contacts an RF connector, it will press the second spring 232 (332) to move and retract the latter upwards in the cylindrical shank 23 (33). By virtue that the protecting cylinder 233 (333) is only pressed by the second spring 232 (332), it can be rotated or tilted in the cylindrical shank 23 (33) (such as are shown by dotted lines in FIGS. 9 and 13).

By the movability of the protecting cylinder 233 (333) of the present invention, when it contacts an RF connector, even when the entire testing multi-connector set is not able to be perpendicular to the electric circuit board, by the self-adjusting function of the protecting cylinder 233 (333), the recess 224*b* (324*b*) of the secondary female probe 224 (324) can be correctly slipped over the central probe of the RF connector. Meantime, by the fact that the secondary female probe 224 (324) can be moved up and down by protruding and retracting, it keeps normal pressure when in contacting, and thereby correctness of the result of testing can be increased.

The most important function of the present invention is to test simultaneously with a plurality of testing connectors and a plurality of RF connectors on the electric circuit board; this renders large reducing to test time. Particularly when in testing a large amount of electric circuit boards as a batch, the present invention needs only to adjust the spaces between the fixed testing connector 20 and the adjustable testing connectors 30 once, and can thus test all electric circuit boards, no more space adjusting is needed. Even when sometimes the RF connectors may have errors in level by the difference of the amount of tin they are probably attained, the present invention is much convenient and fast as compared with the single conventional testing connector.

The embodiment described and depicted is only for illustrating a preferred embodiment of the present invention; it will be apparent to those skilled in this art that various equivalent modifications or changes can be made to the elements of the present invention without departing from the spirit and scope of this invention, such as the number of adjustable testing connector can be reduced to one or the number of RF connector can be added for one more. And all such modifications and changes also fall within the scope of the appended claims.

The invention claimed is:

1. A multi-connector set for signal testing, said multi-connector set is connected with a plurality of radio frequency (RF) connectors on an electric circuit board to take high-frequency signal for an analyzer to measure and analyze, and comprises:

a base seat being a rectangular member;

a fixed testing connector provided on said base seat, and having a Sub-Miniature Type A (SMA) female connector connecting with an SMA male connector on a tailing end of a coaxial electric cable, and an end of a probe of said SMA female connector is connected with a probe provided at a center of an RF connector, and at least an adjustable testing connector provided on said base seat, and spacing of said adjustable testing connector from said fixed testing connector is adapted for adjusting, said adjustable testing connector has an SMA female connector connecting with said SMA male connector on said tailing end of said coaxial electric cable, and said end of said probe of said SMA female connector is connected with said probe provided at said center of said RF connector.

2. The multi-connector set for signal testing as claimed in claim 1, wherein said base seat has at least an elongate hole for receiving said at least an adjustable testing connector; and position of said adjustable testing connector in said elongate hole is adapted to adjusting its position and space from said fixed testing connector.

3. The multi-connector set for signal testing as claimed in claim 2, wherein said at least an adjustable testing connector has a cylindrical shank of which an upper end is formed an SMA female connector, and of which a flange is formed at its middle, diameter of said flange is larger than width of said elongate hole; said cylindrical shank is extended from a bottom of said base seat through said elongate hole to make said SMA female connector protrude out of a top of said base seat, and a screw as well as a set of gaskets each with a diameter larger than a width of said elongate hole are screw connected with an outer screw thread of said SMA female connector, thus said SMA female connector and said flange are together fixedly clamped on said base seat.

4. The multi-connector set for signal testing as claimed in claim 3, wherein said probe of said at least an adjustable testing connector is formed on its upper end an insertion hole, and is formed on its lower end an inner hole; said inner hole has therein a first spring which contacts a lower enlarged portion above a secondary female probe that is adapted for moving up and down by protruding and retracting; said secondary female probe is formed on its bottom a recess to slip over said probe provided at said center of said RF connector; a middle insulating seat is provided in a middle section of said cylindrical shank to afford extending through of said probe of said adjustable testing connector; and said middle insulating seat is provided therebeneath with a second spring which contacts an upper edge of a lower protecting cylinder; said protecting cylinder is provided in its upper interior with a lower insulating seat to afford extending through of said probe of said secondary female probe; said upper outer edge of said protecting cylinder is formed a flange, a diameter of said flange is larger than a diameter of an opening of on a bottom of said cylindrical shank; said protecting cylinder envelops said recess of said secondary female probe, and presses said second spring to move up and down by protruding and retracting on said bottom of said cylindrical shank or to rotate or tilt.

5. The multi-connector set for signal testing as claimed in claim 4, wherein said cylindrical shank of said at least an adjustable testing connector is composed of an upper cylinder and a lower cylinder slipped in said upper cylinder and a middle insulating seat is provided at a slip-connecting position of said upper cylinder and said lower cylinder.

6. The multi-connector set for signal testing as claimed in claim 4, wherein said middle insulating seat in said at least an adjustable testing connector and said second spring have therebetween an O shaped ring.

7. The multi-connector set for signal testing as claimed in claim 4, wherein amount of said at least an adjustable testing connector is two, and said two adjustable testing connectors are respectively provided at two lateral sides of said fixed testing connector.

8. The multi-connector set for signal testing as claimed in claim 1, wherein said SMA female connector of said fixed testing connector is provided at a center in a front face of said base seat, and a probe of said fixed testing connector is bent for an angle of 90 degrees in said base seat; said probe is formed on its lower end an inner hole which is provided therein with a first spring that contacts a lower enlarged portion above a secondary female probe adapted for moving up and down by protruding and retracting in said inner hole; and said secondary female probe is formed on its bottom a recess to slip over a probe provided at said center of said RF connector on said electric circuit board; and more, said cylindrical shank of said fixed testing connector extends downwards within and from a bottom of said base seat; said cylindrical shank has in its middle section a middle insulating seat to afford extending through of said probe of said fixed testing connector; and said middle insulating seat is provided therebeneath with a second spring which contacts an upper edge of a lower protecting cylinder; said protecting cylinder is provided in its upper interior with a lower insulating seat to afford extending through of said probe of said secondary female probe, an upper outer edge of said protecting cylinder is formed a flange, a diameter of said flange is larger than a diameter of a bottom opening of said cylindrical shank; said protecting cylinder envelops said recess of said secondary female probe, and presses said second spring to move up and down by protruding and retracting on a bottom of said cylindrical shank or to rotate or tilt.

9. The multi-connector set for signal testing as claimed in claim 8, wherein said cylindrical shank of said fixed testing connector is composed of an upper cylinder and a lower cylinder slipped in said upper cylinder, a top of said upper cylinder is extended into said base seat to tightly fit therein, said lower cylinder is slipped in said upper cylinder from below, and said middle insulating seat is provided at a slip-connecting position of said upper and said lower cylinders.

10. The multi-connector set for signal testing as claimed in claim 8, wherein said middle insulating seat in said cylindrical shank of said fixed testing connector and said second spring have therebetween an O shaped ring.

* * * * *